United States Patent [19]

Askew

[11] 4,099,787

[45] Jul. 11, 1978

[54] MINING MACHINE

[75] Inventor: William Askew, Wakefield, England

[73] Assignee: Dresser Europe, S.A., Brussels, Belgium

[21] Appl. No.: 788,896

[22] Filed: Apr. 19, 1977

[30] Foreign Application Priority Data

Apr. 23, 1976 [GB] United Kingdom ..... 16699/76

[51] Int. Cl.[2] ..... E21C 29/22

[52] U.S. Cl. ..... 299/43; 299/32; 299/33; 173/160

[58] Field of Search ..... 299/32, 34, 42, 43, 299/47, 48, 33; 173/160; 74/29, 422; 105/29 R, 96, 124, 127

[56] References Cited

U.S. PATENT DOCUMENTS

| | | | |
|---|---|---|---|
| 1,761,060 | 6/1930 | Van Slyke | 299/33 |
| 2,539,962 | 1/1951 | Mavor | 299/32 |
| 3,537,754 | 11/1970 | Valantin | 299/32 |
| 3,665,771 | 5/1972 | Blatt | 74/29 |
| 4,025,120 | 5/1977 | Balinov et al. | 299/43 |

FOREIGN PATENT DOCUMENTS

| | | | |
|---|---|---|---|
| 160,487 | 5/1964 | U.S.S.R. | 173/160 |

*Primary Examiner*—Ernest R. Purser
*Assistant Examiner*—Nick A. Nichols, Jr.
*Attorney, Agent, or Firm*—Larson, Taylor and Hinds

[57] ABSTRACT

A conveyor-mounted mining machine incorporates at least two driving units. Each unit comprises a linearly drivable member operatively engaged with a driven wheel coupled by a clutch to a driving wheel drivingly engaged with a stationary part of the conveyor. With the clutch engaged, linear motion of the linearly drivable member imparts rotary drive to the driving wheel so as to propel the machine along the conveyor. The driving units are operated sequentially so that a continuous drive effort acts on the machine.

9 Claims, 4 Drawing Figures

MINING MACHINE

Figure 1:
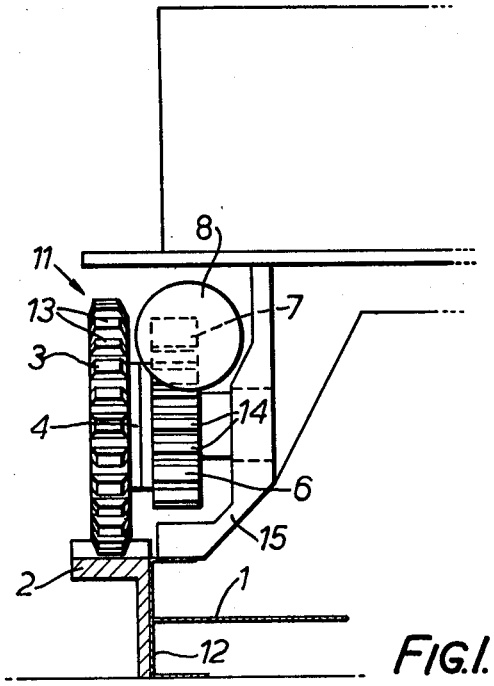

This invention relates to a mining machine.

Displacement of previous conveyor mounted mining machines can be obtained by the use of a haulage mechanism in the form of a travelling winch arrangement including a wire rope or round link chain extending between two fixed points at or near the ends of the conveyor. The winch arrangement comprises a driven drum, carried by the machine and around which the rope is wound, or a toothed sprocket whose teeth engage with the links of the chain. The drum or sprocket is driven via mechanical reduction gearing.

A disadvantage of such machines is that, in use, very high tensions act in the rope or chain which, in view of its relatively long length, is likely to whip out of position, move suddenly or break, and this is likely tocreate a real danger to underground workers in close proximity to the mining machine.

Although not disclosing a mining machine, German patent No. 52511 does disclose a drive, not employing a rope or chain haulage system, which would be suitable for use in a mining machine and would not be subject to the disadvantage mentioned above. In this German patent, a drive for a steam locomotive comprises a toothed driving wheel, engaged with teeth on a stationary rack extending longitudinally along the track, and a reciprocating connecting rod whose reciprocatory motion imparts rotary drive to the driving wheel, by means of a crank on the driving wheel shaft, so as to propel the locomotive along the track. A disadvantage of such a drive is that the driving torque transmitted to the driving wheel is not constant owing to the use of the crank, and two such drives in fact are employed with both driving wheels rotating the same shaft and with the cranks angularly offset from one another about the shaft axis so as to reduce driving torque fluctuations. This arrangement is, however, relatively complex constructionally.

In U.S. Pat. No. 1,761,060, a drive for a mining machine comprises a plunger disposed in a cylinder and driven in a working stroke by water under pressure admitted to the cylinder and returned on a return stroke by a compression spring. On the end of the plunger projecting from the cylinder is a rack whose teeth engage with a pinion formed integrally with a roller ratchet clutch on a drive shaft bearing two driving wheels resting on the mine floor. During each working stroke the driving wheels are caused to rotate whereas during each return stroke the drive is disconnected from the driving wheels and the pinion rotates on the drive shaft by means of the ratchet clutch. In this machine, the driving torque is substantially constant but the drive effort is intermittent.

The present invention aims to provide a mining machine in which a substantially constant driving torque is applied to the driving wheels and in which a continuous driving effort is produced.

According to the invention there is provided a conveyormounted mining machine including at least two drive units each comprising:

(i) a linearly drivable member, (ii) a driven wheel with which the linearly, drivable member is operatively engaged, (iii) a driving wheel drivingly engaged with a stationary member of the conveyor, and (iv) a clutch by which the driven wheel is coupled to the driving wheel, whereby linear motion of said linearly drivable member imparts rotary drive to the said driving wheel, when the clutch is engaged, so as to propel the machine along the conveyor, the drive units being operable sequentially whereby to propel the machine continuously along the conveyor.

In one preferred construction, the machine incorporates two drive units disposed at the goaf side of the machine at longitudinally separated locations, and the conveyor includes a single stationary member at its goaf side. This has the advantage that the drive units are readily accessible for maintenance purposes, even when the mining machine is at the coal face. In a modification the machine again incorporates two drive units but they are disposed opposite one another on opposite sides of the machine and the conveyor includes two stationary members on its two sides respectively.

In another construction, at each of the two locations separated from one another longitudinally of the machine a drive unit is provided at each side of the machine, and the conveyor includes two stationary members on its two sides respectively. With this arrangement, by operating the two drive units at one location alternately with the other two drive units, equal driving efforts are applied at both sides of the mining machine.

In all these cases, when the or each stationary member takes the form of a rack secured to the respective side wall of the conveyor and teeth on the driving wheels engage with the rack(s), no slip of the driving wheels can occur. For similar reasons, it is desirable for each linearly drivable member to comprise a rack engaged with teeth on the driven wheel and coupled to be driven by a hydraulic ram.

The various hydraulic rams and clutches may be operated manually but expediently a control device is provided for automatically controlling operation of the rams and clutches.

The machine may be mounted on the conveyor by means of trapped supports on each side of the conveyor and the drive units are then each mounted alongside or adjacent a said support. In this way the relative positions between the driving wheels and the stationary rack(s) of the conveyor are guaranteed to be fixed.

Figure 2:
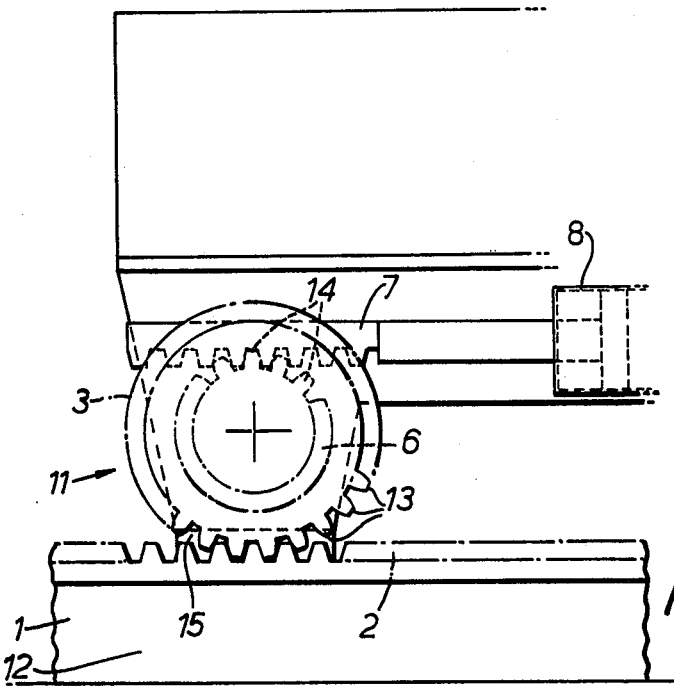
Figure 3:
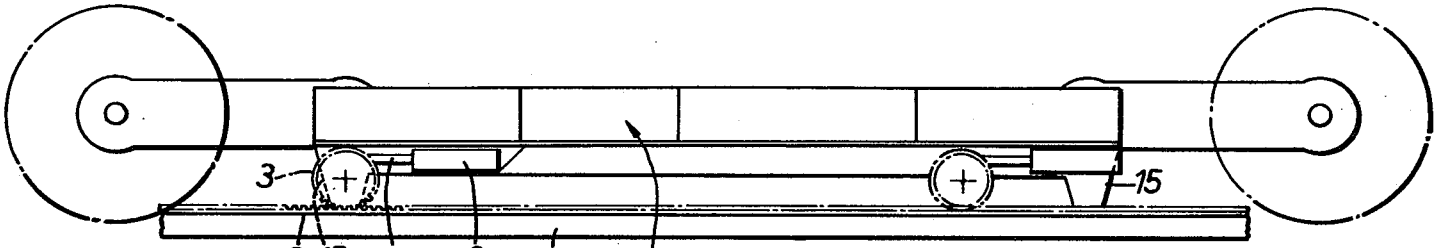
Figure 4:
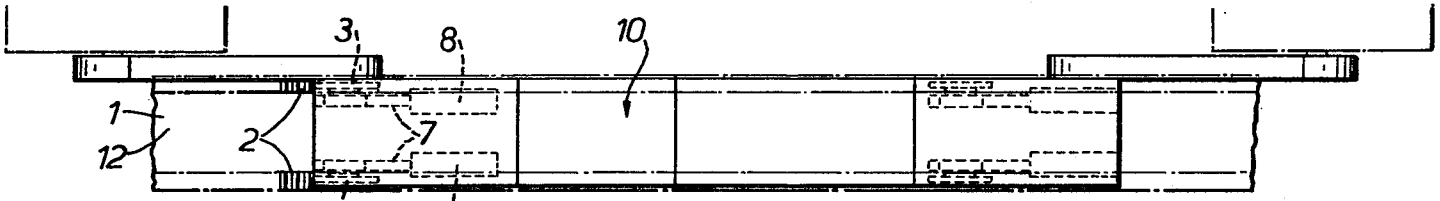

For a better understanding of the invention and to show how the same may be carried into effect, reference will now be made, by way of example, to the accompanying drawings, in which:

FIG. 1 is a diagrammatic view of a drive unit incorporated in a mining machine, the view being in a vertical sectional plane of the machine, FIG. 2 is a side view of the drive unit, FIG. 3 is a diagrammatic side view of a mining machine having four drive units, FIG. 4 is a plan view of this machine.

Referring to FIGS. 1 and 2, a mining machine is mounted on a conveyor 12 comprising a conveyor frame 1 and a fixed rack 2 extending longitudinally of the conveyor and secured to an outer wall of the conveyor frame.

A drive unit 11 of the machine comprises a hydraulic ram 8 fixed to the machine body, a rack 7, mounted in slides on the machine body, which can be driven longitudinally of itself by the ram 8, a driven gear 6 whose teeth 14 are in engagement with the teeth of the rack 7, a driving gear 3 mounted so as to be coaxial with the gear 6 and having its teeth 13 in engagement with those of the rack 2, and a clutch mechanism 4 which, when engaged, couples the gear 6 to the gear 3.

FIGS. 3 and 4 illustrate a mining machine 10 having at each end a ranging armcarrying a rotary cutter. The machine is mounted on the conveyor by means of support members 15 on each side of the conveyor, the machine body being thereby suitably trapped and guided on the conveyor 12. The machine incorporates for example four drive units of the construction described with reference to FIGS. 1 and 2, and these units are each conveniently mounted alongside or adjacent a support member 15 of the machine so as to be disposed at each side of the machine at each of two locations separated from one another longitudinally of the machine. In this way, the relative positions between the driving gears and the fixed racks, respectively on the two sides of the conveyor, are guaranteed to be fixed.

Operation of each drive unit is as follows:

The clutch mechanism 4 is engaged and then the ram is operated to drive the rack 7 linearly and thereby transmit the drive to the gear 3 by way of the gear 6 and clutch mechanism 4. In this way, the machine is driven along its conveyor. It is to be noted that during the working stroke of the rack 7, the driving torque acting on the driving gear 3 is substantially constant.

Once the ram piston has undergone its full travel, the clutch mechanism is disengaged and the ram operated in return the piston to the other end of the ram cylinder ready for the next working stroke. The clutch is then re-engaged, the rack 7 driven once more and so on. In this way the machine can be driven along the conveyor. By using several drive units, the advantage is obtained that the clutch mechanisms can be operated sequentially for example by alternatively bringing into operation both drive units at one end of the machine and both units at the other end of the machine, so as to produce a continuous drive effort provided by the alternate drives of the drive units. The example given of an arrangement of four drive units is preferable in that not only can a continuous drive be produced, but also at any given time equal driving efforts are applied at both sides of the machine.

In another preferred construction the machine incorporates two drive units only which are disposed at the goaf side of the machine at longitudinally separated locations and of which the driving gears engage with a single, fixed, conveyor rack the advantage here being that both drive units are readily accessible for maintainance, even when the mining machine is at the coal face. Alternatively, however, the two drive units may be situated at opposite sides of the machine adjacent one end. In both cases the drive units are operated alternately and trapped supports, by which the machine is mounted on the conveyor, keep the machine aligned with the conveyor at all times.

Advantages of the described construction are that the positions of the drive units permit conveyor manipulation in the vertical and horizontal planes, the hydraulic ram cylinders are fixed on the machine body and so flexible hydraulic connection pipes are not required, the drive units can serve as brakes, merely by locking off the hydraulic rams with valves or by mechanical means, so that the machine can be used safely on inclined seams, and reversible drive for the machine can easily be obtained simply by supplying pressurised hydraulic fluid to the ram piston on what was previously the return stroke with the clutch engaged and by disengaging the clutch on the other stroke.

Controlling the hydraulic pressure supplied to the ram cylinders of the drive units to drive the ram pistons in both directions and engaging and disengaging the clutch mechanisms can be effected automatically by a suitable control device on the machine.

I claim:

1. A conveyor-mounted mining machine including at least two drive units each comprising:

(i) a linearly drivable member, (ii) double-acting drive means arranged to drive said drivable member selectively in opposite directions, (iii) a driven wheel with which the linearly drivable member is operatively engaged, (iv) a driving wheel drivingly engaged with a stationary member of the conveyor, and (v) a clutch by which the driven wheel is coupled to the driving wheel, whereby linear motion of said linearly drivable member in either said direction imparts rotary drive to the said driving wheel, when the clutch is engaged, so as to propel the machine along the conveyor in a selected direction, the drive units being operable sequentially whereby to propel the machine continuously along the conveyor.

2. A mining machine according to claim 1, wherein the machine incorporates two drive units disposed at the goaf side of the machine at longitudinally separated locations, and wherein the conveyor includes a single stationary member at its goaf side.

3. A mining machine according to claim 1, wherein the machine incorporates two drive units disposed opposite one another on opposite sides of the machine, and wherein the conveyor includes two stationary members on its two sides respectively.

4. A mining machine according to claim 1, wherein at each of two locations separated from one another longitudinally of the machine, a drive unit is provided at each side of the machine, and wherein the conveyor includes two stationary members on its two sides respectively.

5. A mining machine according to claim 2, wherein the stationary member comprises a rack secured to the goaf side wall of the conveyor, and teeth on the driving wheels engage with the rack.

6. A mining machine according to claim 3, wherein each stationary member comprises a rack secured to the respective side wall of the conveyor, and teeth on the driving wheels engage with the racks.

7. A mining machine according to claim 4, wherein each stationary member comprises a rack secured to the respective side wall of the conveyor, and teeth on the driving wheels engage with the racks.

8. A mining machine according to claim 1, wherein each linearly drivable member comprises a rack engaged with teeth on the driven wheel and wherein each said double-acting drive means comprises a hydraulic ram.

9. A mining machine according to claim 1, wherein a control device is provided for controlling the sequential operation of the drive units so as to propel the machine continuously along the conveyor.

* * * * *